United States Patent [19]

Chabot

[11] Patent Number: 4,635,685

[45] Date of Patent: Jan. 13, 1987

[54] DETACHABLE BIFURCATED CENTER BRACE LOOM HARNESS

[75] Inventor: Leo L. Chabot, Marietta, Ga.

[73] Assignee: Ellison, Pioneer Division, Atlanta, Ga.

[21] Appl. No.: 726,501

[22] Filed: Apr. 24, 1985

[51] Int. Cl.[4] ..... D03C 9/06

[52] U.S. Cl. ..... 139/91

[58] Field of Search ..... 139/91, 92

[56] References Cited

U.S. PATENT DOCUMENTS 993,685 5/1911 Holmes ..... 139/91

FOREIGN PATENT DOCUMENTS 2153731 5/1973 Fed. Rep. of Germany ..... 139/92

445406 2/1968 Switzerland ..... 139/92

*Primary Examiner*—Henry S. Jaudon

*Attorney, Agent, or Firm*—George M. Hopkins

[57] ABSTRACT

An improved bifurcated center brace apparatus for a loom harness that extends between upper and lower harness frame members. One or more center braces extend between the frame members in abutting relationship therewith and are secured to an associated frame member for a quick and simple installation and release. The bifurcated center brace has two spaced apart elongated rod members that extend between the frame members. The center brace has a top bar extending between the top ends of the rod members and a pair of feet connected to and extending inwardly from the bottom ends of the rod members. The top bar and feet abut in surface contact with the upper and lower frame members, respectively. The top bar and the feet are screw mounted to the frame members and can be easily released therefrom. The center brace also has at least one cross bar extending between the elongated rod members.

5 Claims, 3 Drawing Figures

DETACHABLE BIFURCATED CENTER BRACE LOOM HARNESS

BACKGROUND OF THE INVENTION

1. Field of the Invention

This invention relates to weaving and more particularly to an improved bifurcated center brace for a loom harness.

2. Description of the Prior Art

It is well known that weaving consists of interlacing two sets of threads together at right angles to form a continuous web. For example, to form a plain weave, the warp yarns or the lengthwise yarns and the filling yarns or the crosswise yarns intersect so that ultimately the warp yarn goes over one and then under one filling yarn. The filling yarn does likewise with respect to the warp. The minimum number of harnesses required to produce this weave is two. Alternate warp yarns are threaded into harness one and the remaining alternate yarns are threaded into harness two.

Each individual yarn is threaded through a "heddle" or needle. The heddles are held in a frame called the harness. Each harness can be raised or lowered as desired, thus controlling the position of its heddles and warp yarns. Thus the harnesses will shift so that other sets of warp yarns are respectively raised and lowered and a shuttle motion causes the filling yarn to pass under the warp yarns which are raised by the harnesses and to pass over those warp yarns that are retained in their original lower positions by their remaining harnesses. Then the harnesses will shift so that other sets of warp yarns are respectively raised and lowered and the shuttle action again inserts filling yarn. In this way the fabric is woven.

A problem associated with the frames or harnesses has been the installation and removal of one or more center brace members which extend between the upper and lower members of the harness or frame members. The center brace member must provide proper support for the frames as they move up and down during the operation, while at the same time it is essential that the center brace member or members, depending upon the length of the harness, be able to be installed or detached rapidly and simply and without interfering with the yarns, heddles or other operating apparatus. It is particularly important that the center brace member provide sufficient support to the frame members without weakening the frame members.

Still another problem associated with the center brace member is that this member must be sufficiently strong but not too wide. It has been found that a wide brace member causes streaking of the cloth due to the close proximity of the center brace, in relation to the flat reeds or profile reed, depending on the loom construction. However, if the center brace members are relatively narrow there may be a problem from the standpoint of strength and support for the frame members. Furthermore, it is desirable that when installing or detaching the center brace members that there be a minimum of interference with the yarns and heddles described above.

A bifurcated center brace apparatus has been described in the prior art, but it is expensive and time consuming to manufacture because it can only be made of customized materials. Also, the design of the prior art device incorporates a relatively small opening that limits the movement of those harnesses having the widest shed opening, which ultimately prevents the shed from opening to its maximum distance.

Therefore, the major objective of this invention is to provide a center brace apparatus that overcomes the problems of the prior art discussed above and that is also easy and inexpensive to manufacture.

SUMMARY OF THE INVENTION

Briefly described, the present invention is for an improved bifurcated center brace apparatus having first and second elongated rod members extending in a spaced apart relationship between the upper and lower frame members of the loom harness. The center brace has a top bar extending between the top ends of the rod members and a pair of feet connected to and extending inwardly from the bottom ends of the rod members. The top bar and feet abut in surface contact with the upper and lower frame members, respectively. The top bar is screw mounted through the top of the upper frame member and the feet are screw mounted to the lower frame member and can be easily released therefrom when so desired. The center brace also has at least one cross bar extending between said first and second elongated rod members.

DESCRIPTION OF THE PREFERRED EMBODIMENTS

Figure 1:
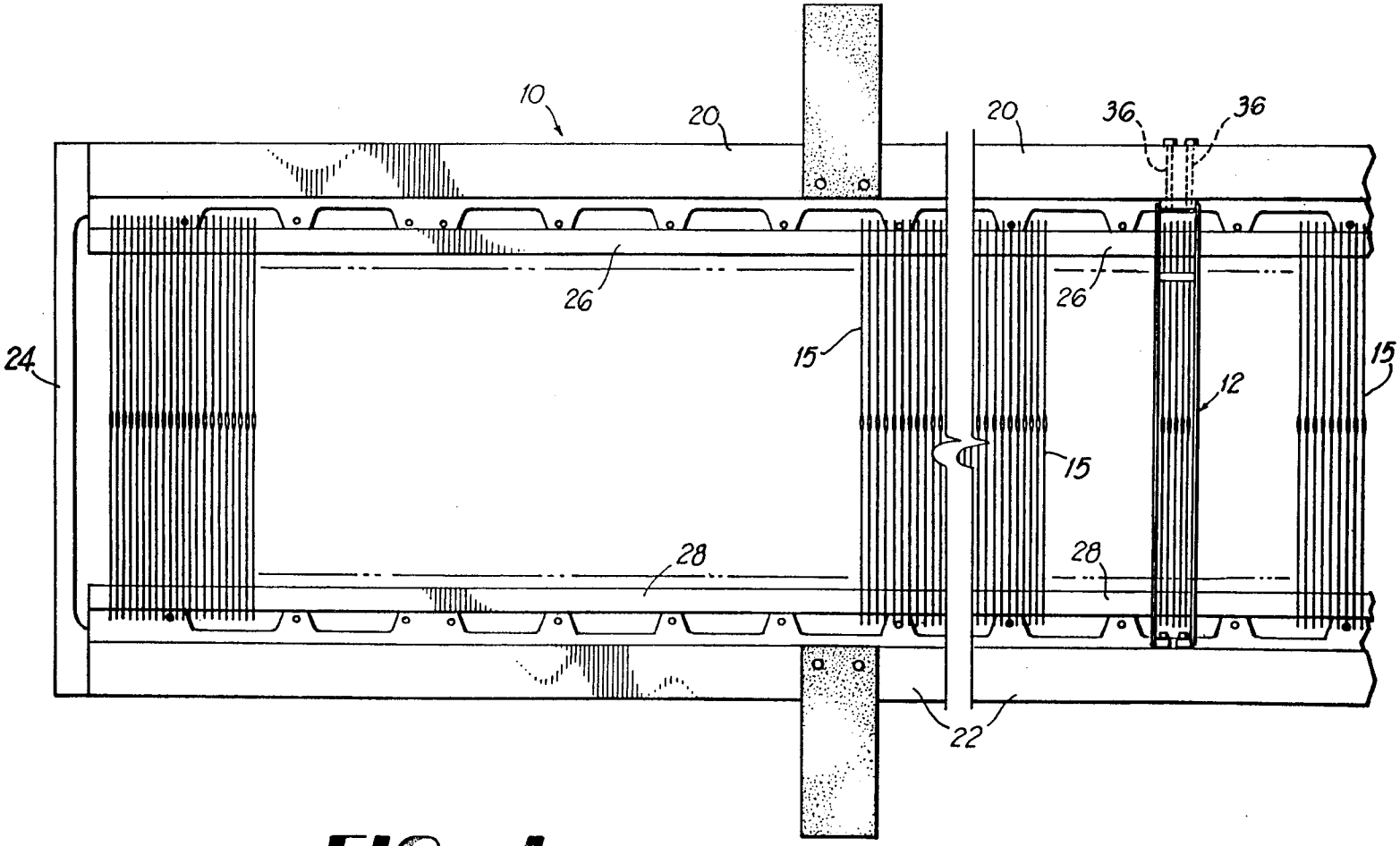
FIG. 1 is a partial front elevation view of a loom harness incorporating the improved bifurcated center brace of the present invention.

Referring now to FIG. 1, there is shown the frame or harness 10 of a loom incorporating a center brace apparatus 12 according to the invention. A plurality of heddles or needles 15 supported on the frame are used for threading warp yarns (not shown). The frame can be raised or lowered, as desired, thus controlling the position of heddles and warp yarns. The frame includes an upper frame member 20, a lower frame member 22, end member 24, upper heddle support 26, and lower heddle support 28. Center brace apparatus 12 serves to support the upper and lower frame members 20 and 22.

Figure 2:
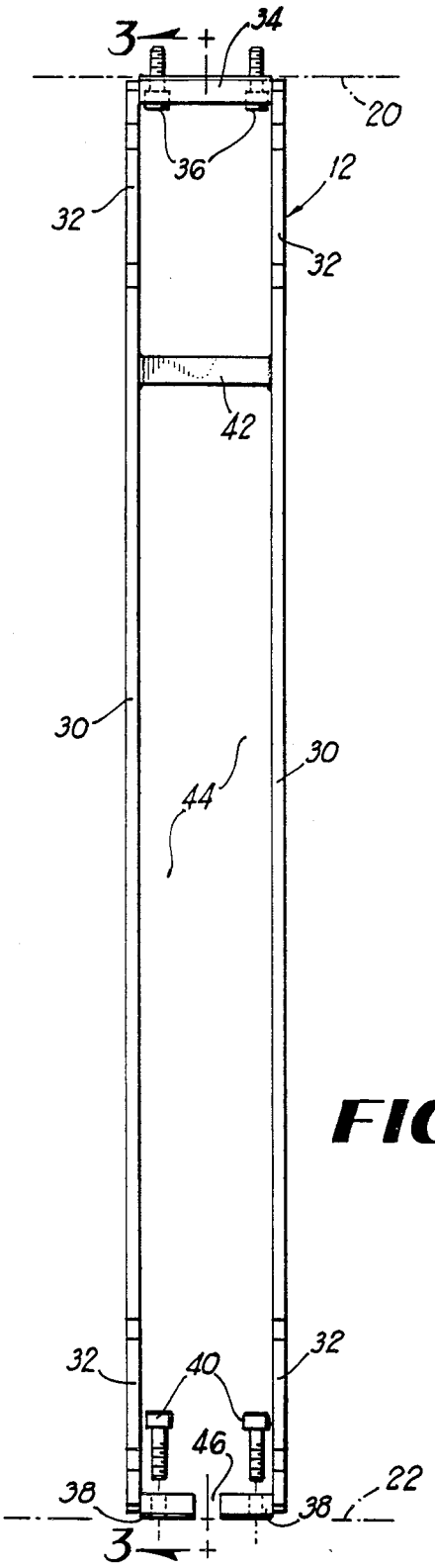
FIG. 2 is an enlarged rear elevation of the improved bifurcated center brace.
Figure 3:
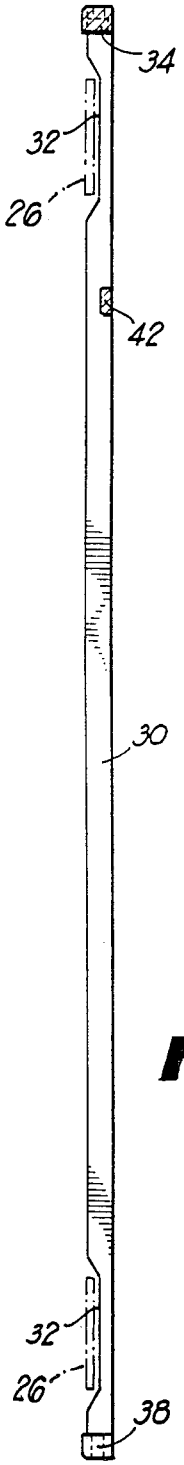
FIG. 3 is a cross-sectional view of the improved center bifurcated center brace taken along line 3—3 in FIG. 2.

Referring now to FIGS. 2 and 3, in accordance with the present invention, center brace apparatus 12 is easily detached from the frame members without interfering with or otherwise removing any of the heddles. Center brace apparatus 12 includes elongated rod members 30 having recessed portions 32, illustrated in FIG. 3, in close proximity to the ends of rod members 30, in order to bypass heddle support members 26 and 28. Top bar 34 extends between and connects the top ends of rod members 30. Top bar 34 also abuts in surface contact to upper frame member 20 and has at least one hole for receiving screw members 36 so that center brace apparatus 12 can be secured through either the top (FIG. 1) or the bottom (FIG. 2) of upper frame member 20. A pair of feet 38 are connected to and extend inwardly from the lower ends of rod members 30. Feet 38 also abut in surface contact to lower frame member 22, each foot containing at least one hole therein for securing feet 38 to lower frame member 22 by screw members 40. Feet 38 extend inwardly to define a channel 46 that is approximately 0.25 inches wide. It is important that the width of channel 46 be sufficient to enable the warp yarns to pass therethrough. Also, slot opening 44, as defined by rod members 30, has sufficient width of about 1.4 inches to ensure that there is no interference with the heddles during installation or detachment of the center brace. At least one cross bar 42 extends between rod members 30, preferably situated above the mid-section of rod members 30. Cross bar 42 serves to reinforce and stabilize rod members 30 during the weaving process. Also, as seen in FIG. 3, the width of cross bar 42 is less than that of rod member 30, so that heddles 15 (see FIG. 1) can be mounted between rod members 30.

Elongated rod members 30 are connected to top bar 34, cross bar 42, and feet 38 by any suitable manner, such as welding. Top bar 34 and feet 38 can be mounted to frame members 20 and 22 by any suitable means, however, as detailed above, screw mounts have been found to be convenient. By this structure and mounting means the center brace may be installed or removed simply and rapidly.

In order to provide adequate support to the frame members 20 and 22, center brace 12 is constructed of a heavy duty flat wire having a thickness of about 0.1 inch and a width of about 0.25 inches. It will be understood, however, that these dimensions and those set forth above are not intended to be limiting, but are merely set forth to define a preferred embodiment. The length of rod members 30 is determined by the size of loom harness for which the center brace is designed.

It will now be appreciated that, by virtue of the unique construction of the center brace apparatus, the center brace member may be installed and detached from the frame or harness rapidly and simply. Moreover, the installation and removal of the center brace member does not interfere with the heddles.

It will also be appreciated that the center brace apparatus of the invention is sufficiently strong to support the frame or harness as needed. Furthermore, the installation of the center brace does not require penetration through the upper or lower frame members of the harness. Moreover, the center brace member is replaceable while on the loom with heddles in place and can be installed or released from either above or below the frame.

It has been found that the width of the slot opening 44 and the decreased thickness of cross bar 42, with respect to elongated rod members 30, permits the insertion of heddles therebetween and consequently the improved bifurcated center brace member described above significantly eliminates streaking by not disturbing the reed dents when the lay is at back center, as is the case with wide column center braces which cause a wide separation between the heddles. Also, good stability is provided by the improved bifurcated center brace member.

It will be appreciated by those skilled in the art that changes can be made to the foregoing apparatus without departing from the spirit of the invention or the scope of the following claims.

What is claimed is:

1. An improved center brace apparatus for a loom harness of the type having upper and lower frame members and corresponding upper and lower supports upon which heddles are mounted comprising:

first and second elongated rod members extending in a spaced apart relationship between the upper and lower frame members forming a slot opening through which warp yarns pass;

a top bar extending between and connecting the top ends of said first and second elongated rod members;

at least one cross bar extending between said first and second elongated rod members wherein said at least one cross bar has a thickness less than that of said elongated rod members to permit heddles to be mounted between said first and second rod member;

a pair of feet connected to and extending inwardly from the bottom ends of said first and second elongated rod members;

a means for mounting said center brace to the loom harness.

2. The invention of claim 1 wherein the mounting means comprises each of said feet having a hole formed therein for securing said foot to the lower frame of the harness and the top bar having at least one hole formed therein for securing said top bar to the upper frame of the harness.

3. The invention of claim 1 wherein each elongated rod member has a pair of recesses formed in the front surface of said elongated rod member, each recess situated proximally to the top and bottom ends of said frame.

4. The invention of claim 1 wherein the top bar and pair of feet abut in surface contact with the upper and lower frame members, respectively.

5. The invention of claim 1 wherein the first and second elongated rod members are parallel.

* * * * *